United States Patent [19]

Daly

[11] 4,238,847

[45] Dec. 9, 1980

[54] ELECTRONIC WATCH FOR YACHT RACES

[75] Inventor: Thomas P. Daly, Hauterive, Switzerland

[73] Assignee: Ebauches Electroniques SA., Marin, Switzerland

[21] Appl. No.: 907,700

[22] Filed: May 19, 1978

[30] Foreign Application Priority Data

Jun. 3, 1977 [CH] Switzerland ..... 6859/77

[51] Int. Cl.[3] ..... G04F 8/00

[52] U.S. Cl. ..... 368/89; 368/107; 368/108; 368/113

[58] Field of Search ..... 58/39.5, 74, 50 R, 23 R, 58/145 A; 235/92 PE, 92 T

[56] References Cited

U.S. PATENT DOCUMENTS

| | | | |
|---|---|---|---|
| 3,795,099 | 3/1974 | Tsurnishi | 58/23 R |
| 3,877,216 | 4/1975 | Mounce et al. | 58/39.5 |
| 3,969,886 | 7/1976 | Yoda | 58/23 R |
| 3,980,868 | 9/1976 | Thompson | 235/92 T |
| 4,062,180 | 12/1977 | Meshi et al. | 58/145 D |

FOREIGN PATENT DOCUMENTS 46-57300 7/1971 Japan .

*Primary Examiner*—Ulysses Weldon

*Attorney, Agent, or Firm*—Wender, Murase & White

[57] ABSTRACT

Electronic watch for yacht races capable of being used for effecting a countdown from a warning signal, having sufficient possibilities of control and possessing a clear and easily identifiable display with regard to the time remaining until the starting signal of the race.

The watch comprises control means which permit, by means of some of the electronic circuits incorporated in the intergrated circuit of the watch, starting and stopping of the countdown of at least one of the time sequences preceding the start of a race, correcting the display of at least one of the time sequences, and delaying the start of at least one of the time sequences of the watch, the start of the time sequences being announced by signals external to the watch.

5 Claims, 12 Drawing Figures

ELECTRONIC WATCH FOR YACHT RACES

BACKGROUND OF THE INVENTION

In yacht races competitors must pay attention to a number of acoustic and visual signals delivered by a gun and flags before the start of the race. A distinction must be made between the warning signal, fired ten minutes before the start, the ready signal, fired five minutes before the start, and the starting signal.

Exact knowledge of the above times is indispensable for yachtsmen, for it helps them to pass the starting line exactly at the moment the starting signal sounds. These times may be indicated to the crew, for example, by means of a counter effecting a countdown starting from ten minutes. On the other hand, the failure to recognize the warning signal in time is an error frequently committed by the crew, and it is desirable to have a means for correcting the time during the "get ready" signal. Moreover, it may happen that although the "get ready" signal has already been given, it may be decided to postpone the race. It is then necessary to await a new "get ready" signal to be given, which requires the countdown to be interrupted and the counter to be set back to five minutes.

A mechanical counter is already known effecting a countdown from the warning signal which used a colored disc to indicate the time remaining before the start of the race.

Such a device, however, gives a rather vague reading and only limited possibilities of control.

The object of the present invention is to provide an electronic watch capable of being used for effecting a countdown from a warning signal, having sufficient possibilities of control and possessing a clear and easily identifiable display with regard to the time remaining until the starting signal of the race.

SUMMARY OF THE INVENTION

According to the present invention there is provided an electronic watch for yacht races, said watch comprising a quartz crystal, an integrated watch circuit, a display device, power supply means and control means, wherein said control means permit, by means of some of the electronic circuits of the integrated circuit, starting and stopping of the countdown of at least one of the time sequences preceding the start of a race, for correcting the display of at least one of the time sequences and for delaying the start of at least one of the time sequences of the watch, the start of the time sequences being announced by signals external to the said watch.

The present invention will be described further by way of example, with reference to the accompanying drawings.

DESCRIPTION OF THE PREFERRED EMBODIMENTS

Figure 1:
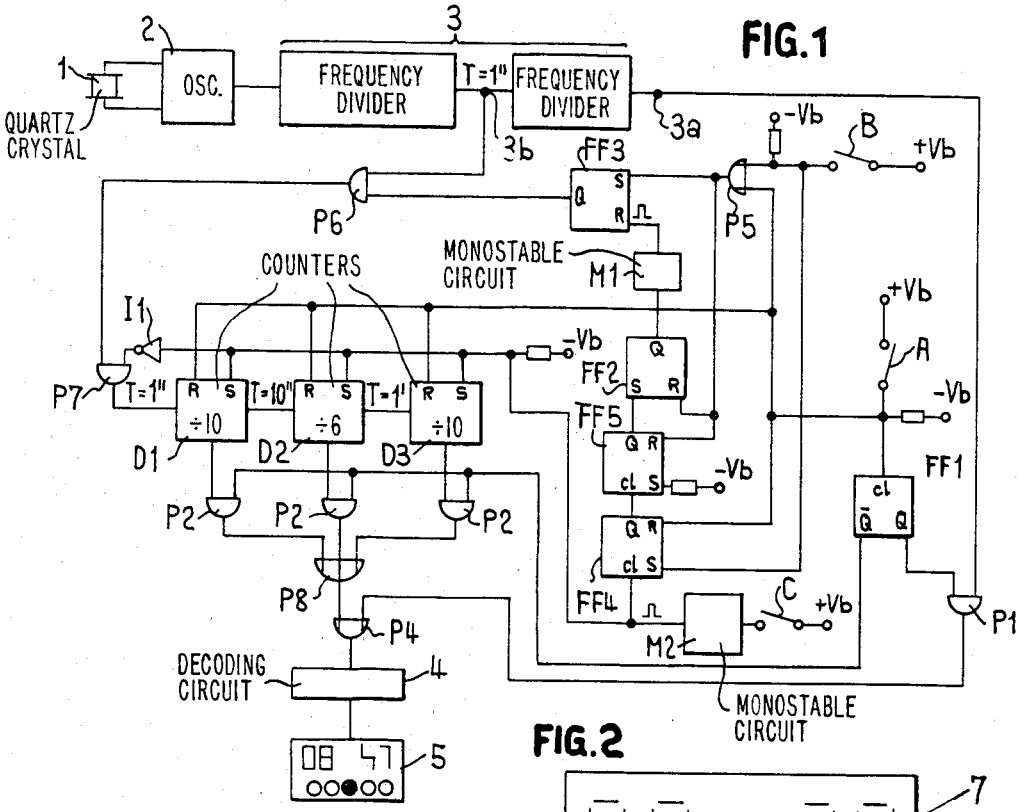
FIG. 1 is a block diagram of the electronic circuits used in an electronic watch for yacht races incorporating a preferred embodiment of the present invention.

FIG. 1 shows the conventional components of an electronic watch, such as a quartz crystal 1, an oscillator 2, a frequency divider 3, a decoding circuit 4 and a display device 5. This circuit also comprises push buttons A, B and C having the following functions, respectively;

A: Changing from the "watch" function to the "yachting counter" function, and starting the ten-minute countdown from the warning time signal B: Start of the five-minute countdown from the "get ready" time signal; and C: Set back to 5 minutes with or without interruption of the countdown, as the case may be.

Normally the signals of the watch, indicating the hour and, if desired, the date, are present at the outputs of the frequency divider 3. In FIG. 1, for the sake of simplicity, it is assumed that these signals are schematically present at the output of 3*a* of the divider 3 and that they are transmitted to the display 5 through gates P1 and P4. It is also evident that the gates P1 and P4 are shown schematically and that in reality they would be replaced by interfaces capable of transmitting the appropriate number of bits to the decoder 4.

By activation of the push-button A when the warning signal sounds, a flip-flop FF1 is changed over, the output Q of which goes to 0 and the output $\overline{Q}$ to 1. These logic states block the gate P1 and open the gates P2 so that the "second, minute and hour" signals of the frequency divider 3, present at the output 3*a* thereof, no longer reach the decoder 4 via the gate P4. The device has thus passed from the "watch" function to the "yachting counter" function. A further activation of the push-button A would return the flip flop FF1 to its starting position and the device to the "watch" function. The operation of the conventional circuits 1, 2 and 3 is not being interrupted in the "yachting counter" position, thus the correct time is not lost when returning to the "watch function".

The activation of the push-button A also has the effect of returning the output Q of a flip-flop FF4 to zero and also, via a gate P5, the flip-flops FF2 and FF5. It further sets the output Q of the flip-flop FF3 at 1 so that the gate P6 becomes conductive for pulses of 1 Hz frequency, present at the output 3*b* of the divider 3. Moreover, activation of the button A returns the dividers DI, D2 and D3 to zero, which operate as back counters. The input of the divider D1 receives 1 Hz pulses from the output 3*b* of the divider 3 through the gates P6 and P7. This latter gate P7 is normally open, the output of the inverter I1 being normally in the state 1. The counter D1 divides the frequency of the pulses at its input by 10 so that it delivers a pulse every 10 seconds at the input of the counter D2. The counter D2 divides by 6 so that it delivers a pulse every minute to the input of the counter D3. Finally, the counter D3 divides by 10. The states of the counters D1, D2 and D3 are transmitted to the decoder 4 through the gates P2, P8 and P4. These gates are shown schematically and, in reality, they would be replaced by interfaces capable of transmitting the appropriate number of bits to the decoder. After the return of the counters D1 to D3 to zero, the first pulse at the input of the counter D1 causes the countdown to begin from 10 minutes. This countdown proceeds until the arrival of a "get ready" signal at a time of 5 minutes. If, upon the arrival of this signal, the yachting counter indicates the exact value of 05.00, no action is exerted, and the countdown continues normally. If, when the get ready signal sounds, the counter indicates a value different from 05.00 minutes, which is often times greater than this value, the button A having been actuated with a delay relative to the warning signal, it is necessary to effect a correction, i.e. return the counters D1 to D3 to the exact value of 05.00 minutes. This operation is effected by an action on the push-button C. The potential +Vb, corresponding to state 1, is applied by the button C to the input of the monostable M2 which delivers a pulse of short duration to the terminals S of the counters D1 to D3 and to the input of the inverter I1, the output of which passes to state 0, thus blocking the gate P7. Hence, during the operation of returning the counters D1 to D3 to the 05.00 value, the input signal is blocked. The countdown, however, resumes immediately at the end of the output pulse of the monostable M2. This pulse has also caused the flip-flop FF4 to change over, the output Q of which is at state 1.

If, a little later, a postponement of the race is announced, it is only necessary to press the button C again, which returns the counters D1 to D3 to 05.00. At the same time, the flip-flops FF4 and FF5 change, the output of the latter passing from zero to 1, thus bringing the Q output of the flip-flop FF2 to state 1 which controls the switching of the monostable M1, the output pulse of which returns the Q output of the flipflop FF3 to zero. It follows that the gate P6 is blocked and the countdown stops. During the sending of a new get ready signal, it is only necessary to press button B to control the input S of the flip-flop FF3 through the gate P5, thus bringing the Q output of the flip-flop FF3 to 1 and unblocking the gate P6, so that the countdown starts again. Actuation of the push-button B also controls the input S of the flip-flop FF4, bringing the output thereof to state 1 and, via the gate P5, the inputs of the flip-flops FF5 and FF2 which are thus returned to zero. If a new postponement is announced, renewed actuation of the button C returns the counters D1 to D3 to zero and changes over the flip-flop FF4, the output of which passes from 1 to 0 and the flip-flop FF5, the Q output of which passes from 0 to 1, thus producing the switching of the monostable circuit and the return of the flip-flop FF3 to zero, so that the countdown is stopped. Pressure on the button B, during a new "get ready" signal, controls the start of a new countdown by means of the flip-flop FF3, the Q output of which is returned to state 1.

The circuit is such that the first correction of the time to 05.00 minutes by means of button C does not stop the countdown, but that any subsequent resetting to 05.00 because of postponement for example simultaneously stops the countdown. Counting may then be restarted by means of button B.

The end of the countdown at 00.00 minutes corresponds to the starting signal; this is the start of the race. From this moment on, an action on button A returns the device to the "watch" function with indication of the time by the display device 5.

It is obvious that the circuit shown in FIG. 1 represents only one of the many possible embodiments, and that the functions of the push buttons A, B and C in particular, may be selected in a different manner without departing from the scope of the present invention.

Figure 2:
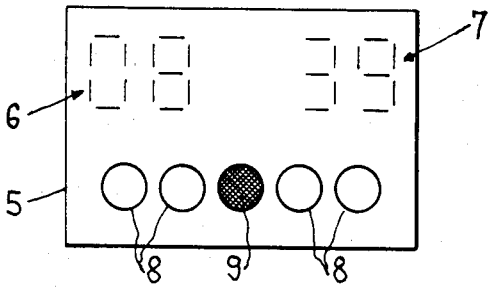
FIG. 2 is a diagrammatic plan view of one embodiment of an arrangement of the display corresponding to the yachting counter portion of the watch.
Figure 3A:
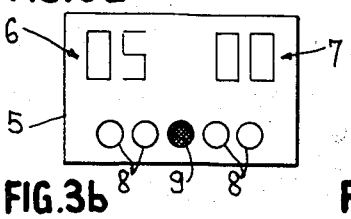
FIG. 3 is a diagrammatic plan view of the display illustrating the evolution of the indicators shown in FIG. 2.
Figure 3B:
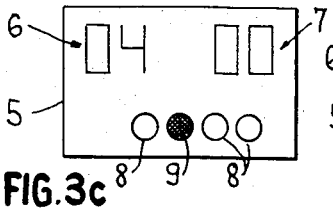
Figure 3D:
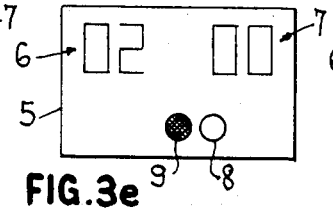
Figure 3F:
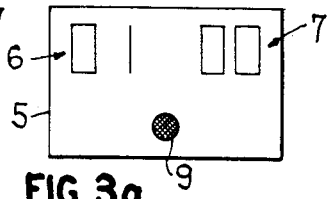
Figure 3C:
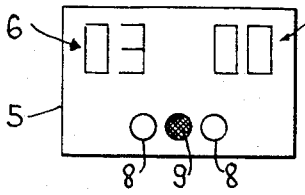
Figure 3E:
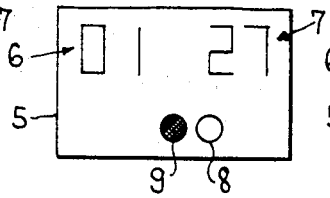
Figure 3G:
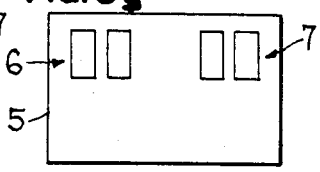

FIG. 2 shows the idea of the display 5 corresponding to the "yachting counter" function. Displayed are the countdown of the minutes for 09 minutes on the display 6 with one digit, and that of the seconds from 59 seconds, on the display 7 with two digits. Moreover, a semi-analog indication of the last five minutes before the start is given by the indicators 8 and 9 which, in FIG. 2, are empty and full circles respectively, but which could be of any other configuration. These signs give, with a single glance, an approximate indication of the time remaining before the start of the race. FIG. 3 shows the evolution of the indicator 8 and 9 in the course of the last five minutes preceding the start. From (a) to (g) in FIG. 3 it can be seen that an indicator disappears each minute alternately on the left and right of the central full indicator 9. The latter sign disappears itself at the instant 00.00 of the start of the race.

Figure 4:
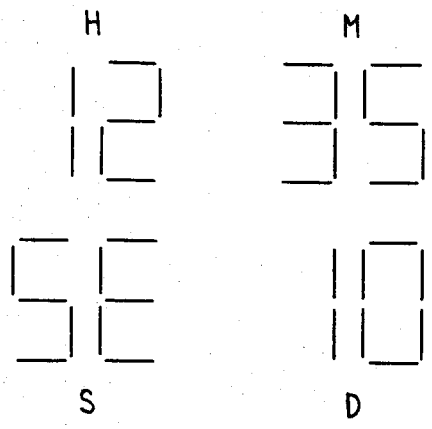
FIG. 4 is a diagrammatic representation of one embodiment of a time display according to the present invention.

FIG. 4 shows another variant of the display of the yachting counter function. This variant uses, more directly than the first, the segments provided for the display of the time in the watch function.

Figure 6:
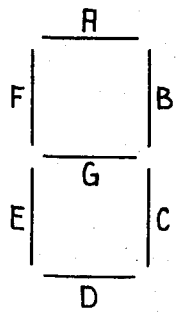
FIG. 6 is a diagrammatic representation of the designation of the segments corresponding to the display shown in FIGS. 4 and 5.

FIG. 4 shows a conventional display corresponding to the watch function having a seven segment display with hours H, minutes M, seconds S, and the date D. The seven segments are represented by the letters A to G, as shown in FIG. 6.

Figure 5:
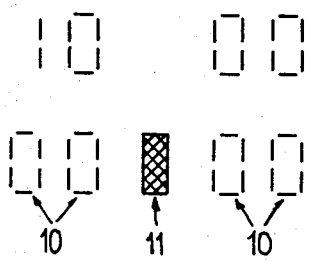
FIG. 5 is a diagrammatic representation of an alternative embodiment of the display of the counter.

FIG. 5 represents, in the same variant, the display corresponding to the yachting counter function, in which the semi-analog indication of the last five minutes before the start of the race is supplied by rectangular symbols 10 and 11. The symbols 10 are formed, in this case, by the segments A, B, C, D, E and F used, as a watch function, to display the seconds and the date. The symbol 11 is therefore the only additional symbol which is necessary to permit the display of the yachting counter function. It is obvious that other variants of such a semi-analog display and, in particular, the appearance or disappearance of the indicators 8 and 9, may be proposed without departing the scope of the present invention.

What we claim is:

1. An electronic watch for yacht races with a display device and an integrated circuit comprising:

an electronic circuit for generating time measurement signals;

a counting circuit coupled to said time measurement circuit and responsive to said time measurement signals for producing signals representative of the countdown of time sequences preceeding the start of a race in response to said time measurement signals;

a logic circuit connected to said counting circuit, said time measurment circuit, and said display device for controlling said time sequences, said logic circuit being receptive of said time measurement signals and said counting circuit signals for delivering one of said signals to said display device;

first control means connected to said logic circuit for selecting between said time measurement signals and said counting circuit signals and for causing said logic circuit to deliver said selected signal to said display device thereby selecting the state of the electronic watch corresponding to a watch function and a yachting counter function respectively, said first control means further having means coupled with said counting circuit for simultaneously starting the countdown of a first of said time sequences in said counting circuit;

second control means connected to said logic circuit for starting the countdown of a second of said time sequences in said counting circuit; and third control means connected to said logic circuit for selecting a first and second state of said counting circuit, said third control means having means for returning said second time sequence countdown in said counting circuit first state to a predetermined value equal to the time remaining before the start of the race and immediately resuming said second time sequence countdown, said third control means further having means for simultaneously stopping said second time sequence countdown after returning said second time sequence countdown in said counting circuit second state to said predetermined value, thereby postponing the start of the countdown of said second time sequence from said predetermined value until said second time sequence is started by actuation of said second control means; and said display device including means responsive to said countdown signals for displaying, during said second time sequence, the time remaining before the start of the race in both digital and semi-analog form in combination on said display device.

2. A watch according to claim 1, wherein said counting circuit comprises back counters receiving pulses from said time measuring circuit, said back counters being set and reset by said logic circuit for determining the start and stop of the countdown of said time sequences.

3. A watch according to claim 1, wherein said logic circuit controls the action of said first, second, and third control means upon said counting circuit and display device.

4. A watch according to claim 1, wherein said display device includes a digital portion which indicates the time of day when said watch is in said watch function state, and indicates the time remaining before the start of the race when said watch is in the yachting counter function state.

5. A watch according to claim 4, wherein said display device includes, in the yachting counter function state, a plurality of indicators representing a semi-analog display for said second time sequence, said indicators being alternately illuminated and extinguished in a predetermined order.

* * * * *